US006926577B2

(12) United States Patent
Thorne, III

(10) Patent No.: US 6,926,577 B2
(45) Date of Patent: Aug. 9, 2005

(54) UNDERWATER DEVICE AND METHOD OF PLAY

(76) Inventor: Edwin Thorne, III, 2507 Westmont Way W, Seattle, WA (US) 98199

( * ) Notice: Subject to any disclaimer, the term of this patent is extended or adjusted under 35 U.S.C. 154(b) by 0 days.

(21) Appl. No.: 10/445,147

(22) Filed: May 24, 2003

(65) Prior Publication Data

US 2004/0235387 A1 Nov. 25, 2004

(51) Int. Cl.[7] ..... A63H 23/06
(52) U.S. Cl. ..... 446/161; 446/180; 446/211
(58) Field of Search ..... 446/161, 162, 446/176, 180, 211

(56) References Cited

U.S. PATENT DOCUMENTS 1,243,287 A * 10/1917 Haigh ..... 446/161
2,214,270 A * 9/1940 Buehler ..... 446/162
2,749,658 A * 6/1956 Neumann ..... 446/156
2,826,001 A * 3/1958 Presnell ..... 446/161
3,571,966 A * 3/1971 Phelps ..... 446/162
4,241,535 A * 12/1980 Tsukuda ..... 446/156
4,274,223 A * 6/1981 Morrison et al. ..... 446/162
4,715,564 A * 12/1987 Kinn et al. ..... 244/153 R
4,826,465 A * 5/1989 Fleischmann ..... 446/162
5,514,023 A 5/1996 Warner
5,882,240 A * 3/1999 Larsen ..... 446/225
6,280,277 B1 * 8/2001 Greenberg et al. ..... 446/161
6,699,091 B1 * 3/2004 Warner ..... 446/153

* cited by examiner

*Primary Examiner*—John A. Ricci
(74) *Attorney, Agent, or Firm*—Peloquin, PLLC; Mark S. Peloquin, Esq.

(57) ABSTRACT

A device for recreational and educational use includes a substantially cylindrical section having a first end, and a second end. A cavity is disposed within the substantially cylindrical section to receive fluid when the device is immersed in a body of fluid. The substantially cylindrical section decreases in radius toward the first end and present a low drag profile to impinging fluid flow. Control surfaces are included on the substantially cylindrical section. A stabilizer is coupled with the substantially cylindrical section, to stabilize motion of the device in the body of fluid when the device is launched by a user. The device can be hand-launched by a user. Energy storage assisted launch mechanisms are also described that assist the user during submarine launch of the device.

35 Claims, 12 Drawing Sheets

UNDERWATER DEVICE AND METHOD OF PLAY

BACKGROUND OF THE INVENTION

1. Field of Invention

The invention relates generally to aquatic hydrodynamic toys, and more specifically to hydrodynamic toys for underwater travel including flight.

2. Art Background

Children and adults alike, play with toys both in and out of the water. Classes of toys that are highly desirable for play include toys that fly through the air. Such toys by their very nature are relatively light since the density of air is relatively small and therefore will not support a heavy toy. Necessarily, toys designed for airborne flight have large wing areas and are rendered unsuitable for underwater travel and flight.

Attempts at designing toys for underwater play have been made in the past. One such attempt has resulted in U.S. Pat. No. 5,514,023 to Warner titled "Hand Launchable Hydrodynamic Recreational Vehicle," (hereinafter Warner). Warner's device is a body having a predefined density that is neutrally buoyant in water. Such a device's weight is countered by the buoyant force of the water thereby suspending the device, as such, the device is said to move through the water. Such movement, along a substantially straight line trajectory following a hand-launch is generally confined to a plane.

Many creatures that live in the water dive and surface following curved flight paths utilizing a complex muscle/skeleton system to control their flight through the submarine environment. Current neutrally buoyant toys do not emulate these undersea creatures.

Furthermore, toys that have a predefined specific gravity, equal to that of water, are quite heavy, thus requiring a large quantity of material to manufacture and then an attendant large expense to ship from the place of manufacture to the point of retail sale which is often many thousands of miles apart.

All of the attempts described above do not mitigate these problems. The attempts previously discussed do not solve the problem of providing an underwater toy that resembles a living creature that is capable of underwater flight. Neither do these attempts alleviate the high cost of shipping heavy neutrally buoyant toys to market from the place of manufacture.

BRIEF DESCRIPTION OF THE DRAWINGS

The invention may best be understood by referring to the following description and accompanying drawings that are used to illustrate embodiments of the invention. The invention is illustrated by way of example in the embodiments and is not limited in the figures of the accompanying drawings, in which like references indicate similar elements. In the drawings.

DETAILED DESCRIPTION

In the following detailed description of embodiments of the invention, reference is made to the accompanying drawings in which like references indicate similar elements, and in which is shown by way of illustration, specific embodiments in which the invention may be practiced. These embodiments are described in sufficient detail to enable those of ordinary skill in the art to practice the invention. In other instances, well-known structures, and techniques have not been shown in detail in order not to obscure the understanding of this description. The following detailed description is, therefore, not to be taken in a limiting sense, and the scope of the invention is defined only by the appended claims.

Figure 1:
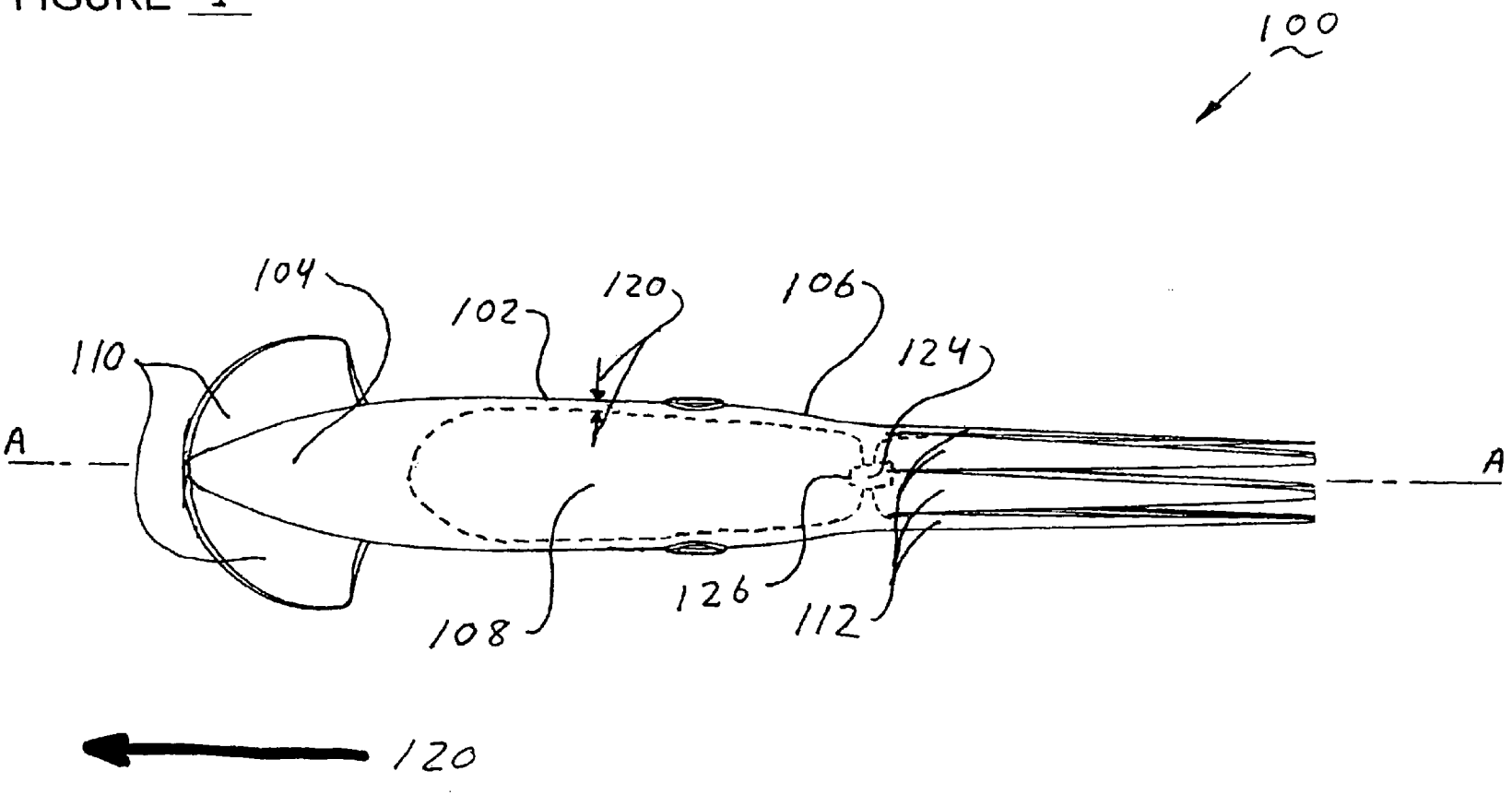
FIG. 1 is a top view of one embodiment of a device.

A device suited to underwater travel, including submarine flight, with a variable density is disclosed. FIG. 1 illustrates a top view of the device according to one embodiment of the invention. With respect to FIG. 1, a device is generally illustrated at 100. Device 100 has a substantially cylindrical section 102 with a first end 104 of decreasing radius. The substantially cylindrical section 102 has a second end 106; the second end 106 is coupled with a stabilizer 112. A cavity 108 is disposed within the substantially cylindrical section 102. Control surfaces 110 are disposed on either side of the first end 104. Cavity 108 fills with fluid upon immersion of the device 100 into a body of fluid. Device 100 will operate in a variety of fluids; however, water is the most widely used fluid for recreational or educational purposes. In one or more embodiments of the invention it may be desirable to operate the device in fluids other than water such as glycerin or alcohol. It maybe desirable to utilize other fluids in embodiments of the invention directed to science classroom experiments designed to measure maximum dive depths and flight times achieved in fluids of varying viscosity and or density. For simplification of the discussion throughout the remainder of this detailed description, fluid will be used as a general term to indicate the medium that the device is immersed into; it will be understood by those of ordinary skill in the art that "fluid" can be fresh water or salt water as well as other non-volatile fluids that are conducive to a user's contact therewith. Also, no limitation is implied herein with reference to water.

In one embodiment, the device 100 can have an overall length measured along axis AA of 300 millimeters, a width of 40 millimeters for the substantially cylindrical section 102, and a width of 70 millimeters measured at the maximum diameter of the control surfaces 110. Control surfaces 110 can have a thickness (measured perpendicular to the plane of FIG. 1 and indicated at 221 in FIG. 2A) that spans a large range. In one or more embodiments the thickness can range from one to four millimeters. The dimensions listed above are typical of one embodiment of the invention. The present invention is not limited by these dimensions but is readily configurable into different sized devices.

The substantially cylindrical section 102 and the stabilizer 112 can be constructed from a variety of materials as desired to match or exceed the density of the fluid device 100 is immersed into. Typical materials useful for designing a device with water as the intended fluid include, but are not limited to polyethylene, urethane or thermoplastic rubber (TPR) such as Kraton® from GLS Plastics. Substantially cylindrical section 102 can have a thickness indicated by 120. The thickness 120 can be variable or uniform according to different embodiments of the invention. Additives to increase a base material density can be added to the base material to achieve a greater final material density as is well known in the art. The substantially cylindrical section 120 can be made from the same material as the stabilizer 112 or different material according to various embodiments of the invention.

To change the location of the center of mass of device 100 along length AA, the first end 104 can incorporate a region of material denser than the density of the body of fluid device 100 is immersed in and denser than the density of the material used to make device 100, thereby shifting the center of mass forward and closer to control surfaces 110. Construction according to this embodiment can counteract the lift generated by control surfaces 110 and provide a more horizontal flight path for the device 100.

Varying states of buoyancy can be achieved by allowing the cavity 108 to partially fill with water through an opening 124, while the device 100 is submerged by a user. The opening 124 can be plugged by the user with a removable stopper 126. Alternatively, other ways of plugging opening 124 can be provided such as a valve built into the opening which would be operable by the user according to many techniques that well know in the art. Alternatively, the stabilizer 124 and the substantially cylindrical section 102 can be constructed as mating parts that disassemble to allow fluid to enter the cavity 108 and then assemble to prevent fluid from leaving the cavity. An embodiment of the invention incorporating this concept is described below with reference to FIG. 3A and FIG. 3B.

The device 100 can be grasped by the user anywhere along the substantially cylindrical section 102 with two or more fingers of one hand. Held underwater, and grasped by the user's hand, the device 100 can be launched by the user; thrusting the device forward in the direction indicated by arrow 120. In one embodiment, the device 100 can be launched by the user at an angle relative to the surface in the direction of the bottom of the body of water (an angle of approximately 45 degrees relative to the surface of the water) such a launch trajectory will generate lift as fluid flows across control surfaces 110 causing the device 100 to fly through an arc turning away from the bottom and toward the surface of the body of water. The density of the device can be adjusted as described above by allowing more or less water into cavity 108 thereby adjusting the flight path taken by the device for a given launch force imparted by the user.

Figure 2A:
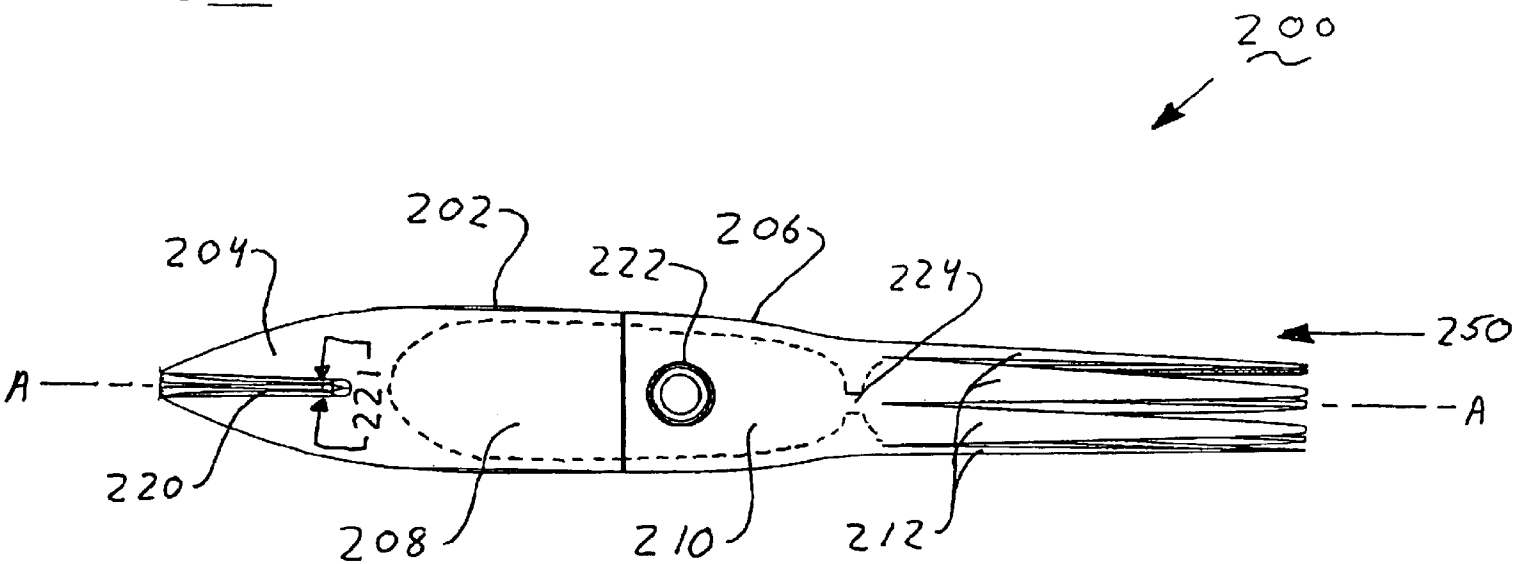
FIG. 2A displays a side view of one embodiment of a device.

FIG. 2A displays a side view of one embodiment of the invention which would be typical of a side view of device 100 shown in FIG. 1. With reference to FIG. 2A, viewed from the perspective therein, device 200 resembles a squid found in marine environments. An eye 222 is disposed on either side of body 206. Body 206 is substantially cylindrical and contains an internal void 210. Body 206 is coupled with a substantially cylindrical head 202. Body 206 is coupled with a stabilizer 212. The stabilizer 212 resembles a marine squid's tentacles. The tentacles 212 minimize drag applied to the body 206 but still provide stability while the device 200 is in flight. The structure of the tentacles also minimizes the amount of material required to form the tentacles, saving weight in the final product and minimizing shipping costs from the place of manufacture to the point of sale.

One or more of the previously described structures, i.e., head 202, body 206, stabilizer 212, and eye 222 can be made with glow additive (glow-in-the-dark additive), as is well known in the art. A glow in the dark appearance enhances the play value of the device. Glow additive is not restricted to the structures listed above, glow additive can be used with all of the embodiments contained in this description, and no limitation is implied herein.

The substantially cylindrical head 202 contains a cavity 208 disposed therein and in communication with an internal void 210. As described with respect to FIG. 1, fluid fills the cavity 208 and the void 210 through the opening 224 when the device 200 is immersed in water. Varying states of buoyancy can be achieved by allowing the internal void 210 to partially fill with water through the opening 224 while the device 200 is submerged by a user or alternatively, the user can pour water into the internal void 210. The opening 224 can be plugged (plug not shown) as described in conjunction with FIG. 1. A removable stopper can be used to plug the opening 224; alternatively a valve can be used. In another embodiment, a valve can be built into the stabilizer 212, such that when the stabilizer is rotated, the opening 224 is closed and then opened. The stabilizer 212 can be configured to be releasably coupled to the substantially cylindrical body 206; thereby preventing fluid from flowing through the opening 224 when attached to the substantially cylindrical body 206 and alternatively allowing fluid to flow through the opening 224 when removed from the substantially cylindrical body 206.

It will be appreciated by those of skill in the art that the variable density aspect of the present invention alleviates the problem of shipping a heavy device that has a density predefined to match water. Device 100 (FIG. 1) and device 200 (FIG. 2A) are substantially lighter due to the incorporation of the cavities and voids, saving weight thereby.

Referring back to FIG. 2A, the radius of the substantially cylindrical head 202 decreases along axis AA in the direction of a first end 204 of the substantially cylindrical head 202 to present a low drag body to the flow that impinges of the first end 204 when the device is moving forward as indicated by arrow 250. Control surface 220 is aligned substantially parallel to the longitudinal axis AA of device 200.

Figure 2B:
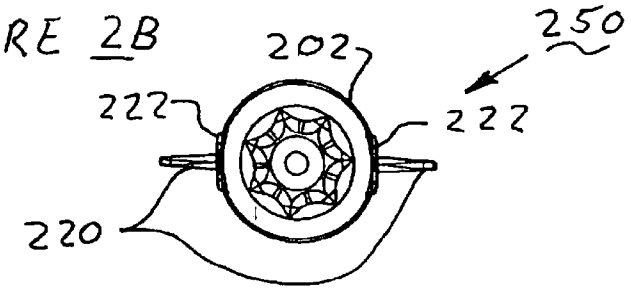
FIG. 2B illustrates a view parallel to a longitudinal axis of the device shown in FIG. 2A.

FIG. 2B illustrates a view parallel to a longitudinal axis of the device, indicated at 250, according to one embodiment of the invention. With reference to FIG. 2B, the orientation of the control surfaces 220 is displayed and the substantial symmetry is evident from this view. Control surface symmetry exists within a plane containing the control surfaces 220. Control surface symmetry also exists within a plane including axis AA and perpendicular to the control surfaces. Such control surface symmetry, used in conjunction with a neutrally buoyant device, provides a zero angle of attack to impinging flow resulting in zero lift, while still providing resistance against pitching of the device while in motion. When in motion, a device incorporating these design elements tracks along a substantially straight path.

In other embodiments of the invention incorporating a variable control surface thickness, the thickness (indicated at 221 FIG. 2A) can range from less than one millimeter to many millimeters in thickness. The thickness of the control surfaces 220 need not be constant but may vary from a thin outer edge of approximately one millimeter in thickness to many millimeters in thickness as the control surfaces merge with the substantially cylindrical head 202. In such an embodiment, the control surface would be faired into the substantially cylindrical head in much the same way a fin merges into the body of a fish with no discernible point of connection.

Control surfaces can be made flexible thus allowing the control surface to flex in the presence of flow, thereby limiting the lift force that is transferred to the device. According to one embodiment, utilizing flexible control surfaces, the thickness of the control surface is approximately one to one and a half millimeters at the point of maximum extent from the substantially cylindrical head 202 to approximately two millimeters where the control surface merges with the substantially cylindrical head 202. These flexible control surfaces (dimensioned as previously described) can be made from urethane or other suitable materials and can be utilized with various embodiments of the device. One such embodiment was described above in conjunction with FIG. 1.

Figure 3A:
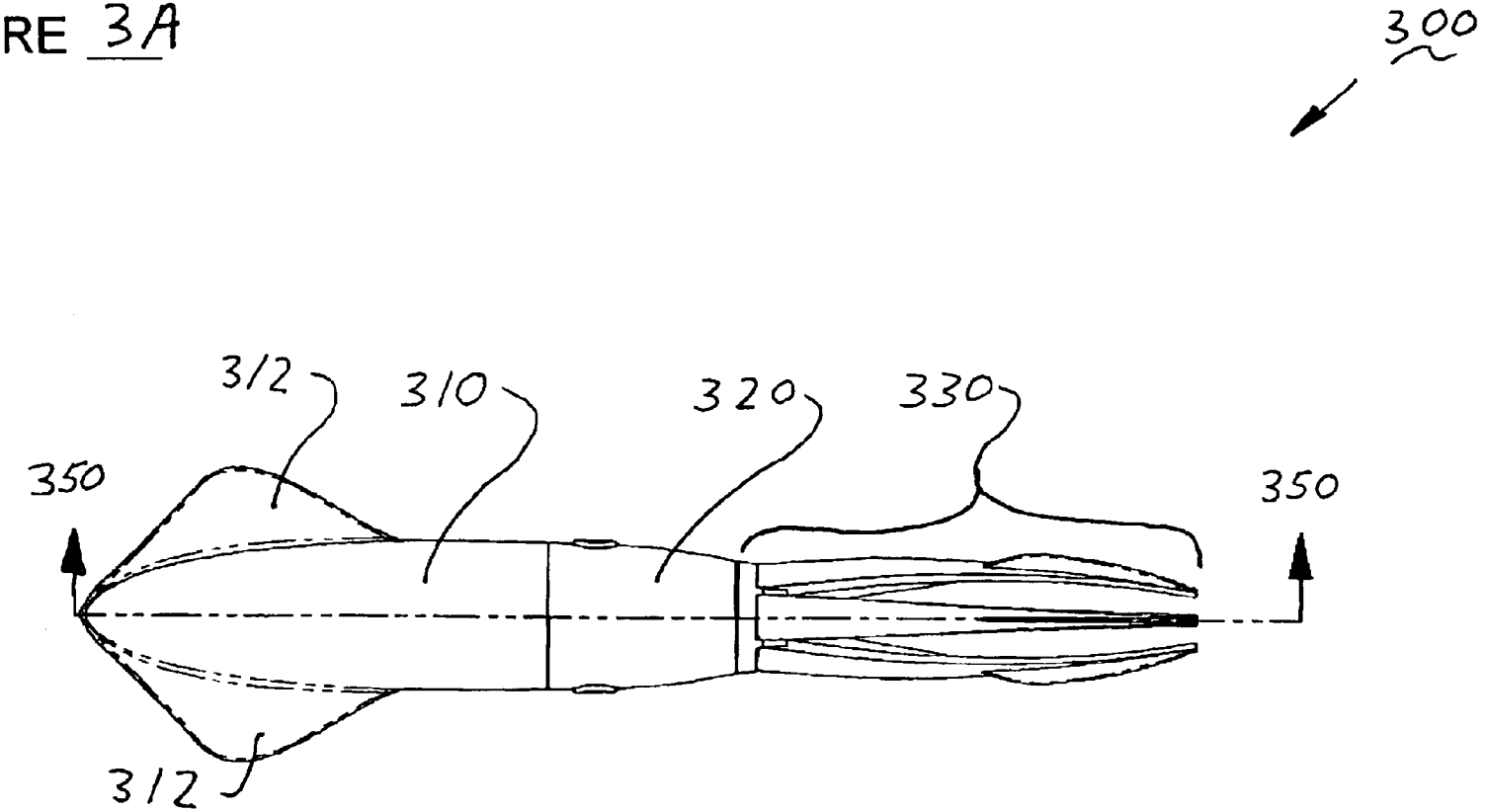
FIG. 3A illustrates a top view of one embodiment of a device.

FIG. 3A illustrates a top view of one embodiment of a device, shown generally at 300. In one embodiment, the device is assembled from three parts shown in an exploded view in FIG. 3B, the exploded view is taken at cross section 350 (FIG. 3A). The device 300 includes a substantially cylindrical head 310 with attached control surfaces 312. A substantially cylindrical body 320 is attached to the substantially cylindrical head 310. A stabilizer 330 is attached to the substantially cylindrical body 320.

Figure 3B:
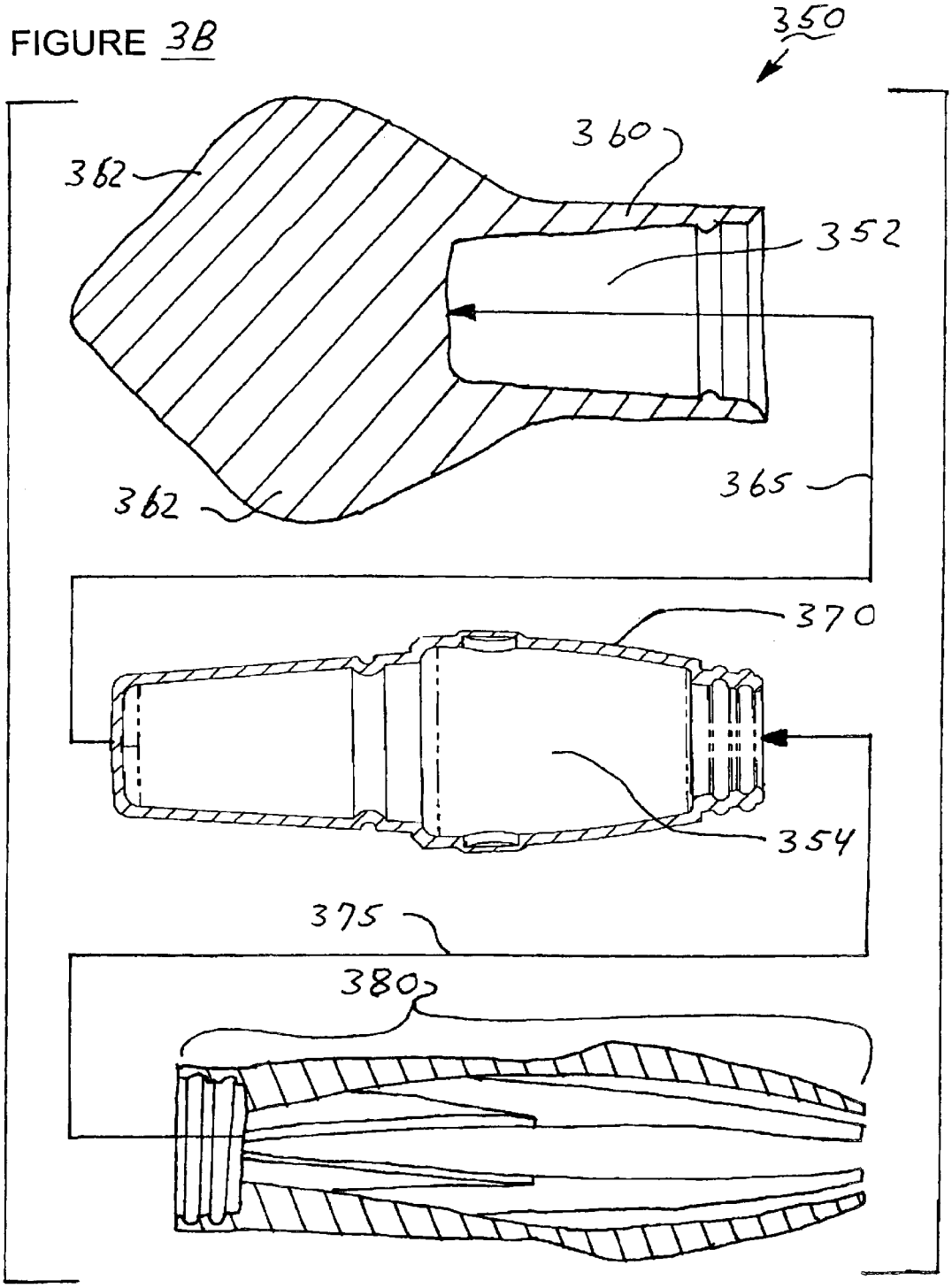
FIG. 3B illustrates a cross-sectional view of the device shown in FIG. 3A.

FIG. 3B illustrates a cross-sectional view of the device shown in FIG. 3A. The substantially cylindrical head 312 (FIG. 3A) is represented in FIG. 3B at 360. The corresponding control surfaces 312 (FIG. 3A) are represented in FIG. 3B at 362. Additionally, a cavity 352 is shown disposed within the substantially cylindrical head 360. A substantially cylindrical body 370 includes a cavity 354 to receive water from the body of water that the device is immersed into (alternatively water or any other fluid can be poured therin). Assembly line 365 indicates the way in which the substantially cylindrical body is located in conjunction with the substantially cylindrical head 360. Assembly of 360 and 370 is completed by insertion of 370 into the cavity 352. A stabilizer 380 is coupled to the substantially cylindrical body 370; the path of assembly is indicated by assembly line 375.

Coupling the components shown in FIG. 3B can be accomplished according to a variety of ways that are well known in the art. In one embodiment, coupling can be accomplished with mating grooves and ridges as illustrated in FIG. 3B. Other methods of coupling can be utilized, as is well known in the art, such as threads, pins, rings or adhesive depending on the choice of materials. For example, compatible materials could be assembled with adhesive. According to one embodiment, the substantially cylindrical head 360 and the stabilizer 380 can be manufactured from thermoplastic rubber and the substantially cylindrical body 370 can be manufactured utilizing a blow molding process with high density polyethylene. Those of ordinary skill in the art will recognize that a variety of other materials and techniques can be readily used for the device shown at 350 and the devices shown in the other drawings within this description. No limitation is implied by the materials and coupling techniques described herein.

Figure 4:
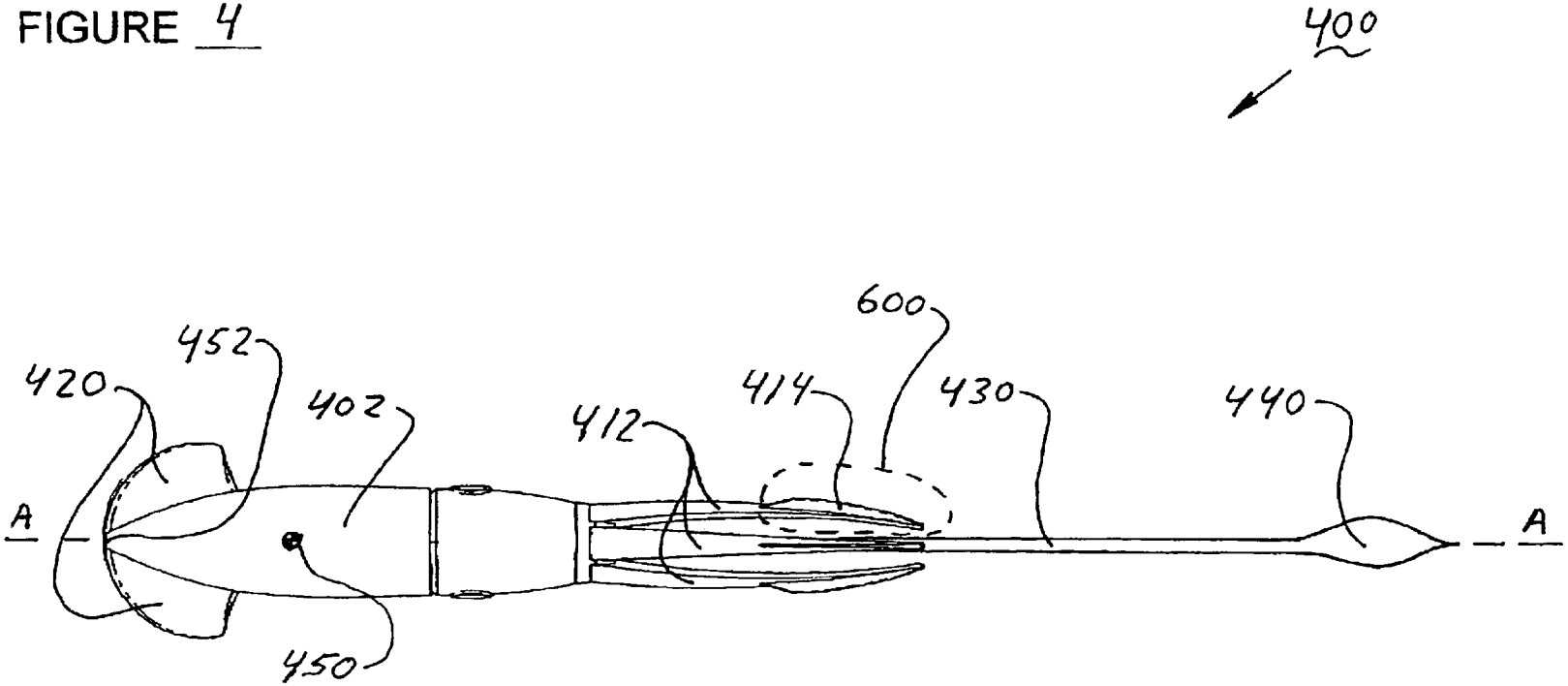
FIG. 4 depicts one embodiment incorporating an aft member and an aft body.

FIG. 4 depicts one embodiment of the invention at 400 incorporating an aft member and an aft body. With reference to FIG. 4, aft member 430 can be attached by inserting one end into an opening (not shown) similar to the opening 224 (FIG. 2A) to secure the aft member to the substantially cylindrical section 402. The aft member 430 can also be used to plug the opening to a cavity or void (not shown) thereby preventing fluid from either flowing into or out of the cavity or void. A stabilizer 412 is coupled to the substantially cylindrical section 402. In the embodiment shown in FIG. 4, at least along a part of the length of the stabilizer, the thickness of the stabilizer varies as a function of the width of the stabilizer. This feature is depicted again in FIG. 5 and FIG. 6, and described more fully in the discussion below.

With reference back to FIG. 4, the device 400 has a center of mass indicated by a symbol at 450. In one embodiment, with the device dimensioned according to the description given in conjunction with FIG. 1, the center of mass 450 is 133 millimeters to the right of the left edge of the device (indicated by 452). The design parameters corresponding to this center of mass location utilize the same material for all parts of the device with the void remaining free of fluid. The aft member 430 adds stability to the device 400 by slowing a rate of rotation about the center of mass 450 when the device 400 is in motion. An aft body 440 can be attached to the aft member 430. Additional aft force can be generated as desired with the aft body 440. The aft body can be formed in the shape of a fin co-planar with the control surfaces 420. Additionally, the aft body can be fashioned into a solid of revolution about its longitudinal axis indicated by AA. The aft body can also consist of a plane or a control surface designed to impart special flight characteristics to the device 400. An example of special flight characteristics is, but is not limited to a turn to the left or right. Such a turn can be imparted by a control surface configured to function as a tail rudder. An aft member configured to emulate a control surface such as a horizontal plane arranged coplanar with control surfaces 420 will improve straight line tracking and make the device 400 resistant to turns.

Figure 5:
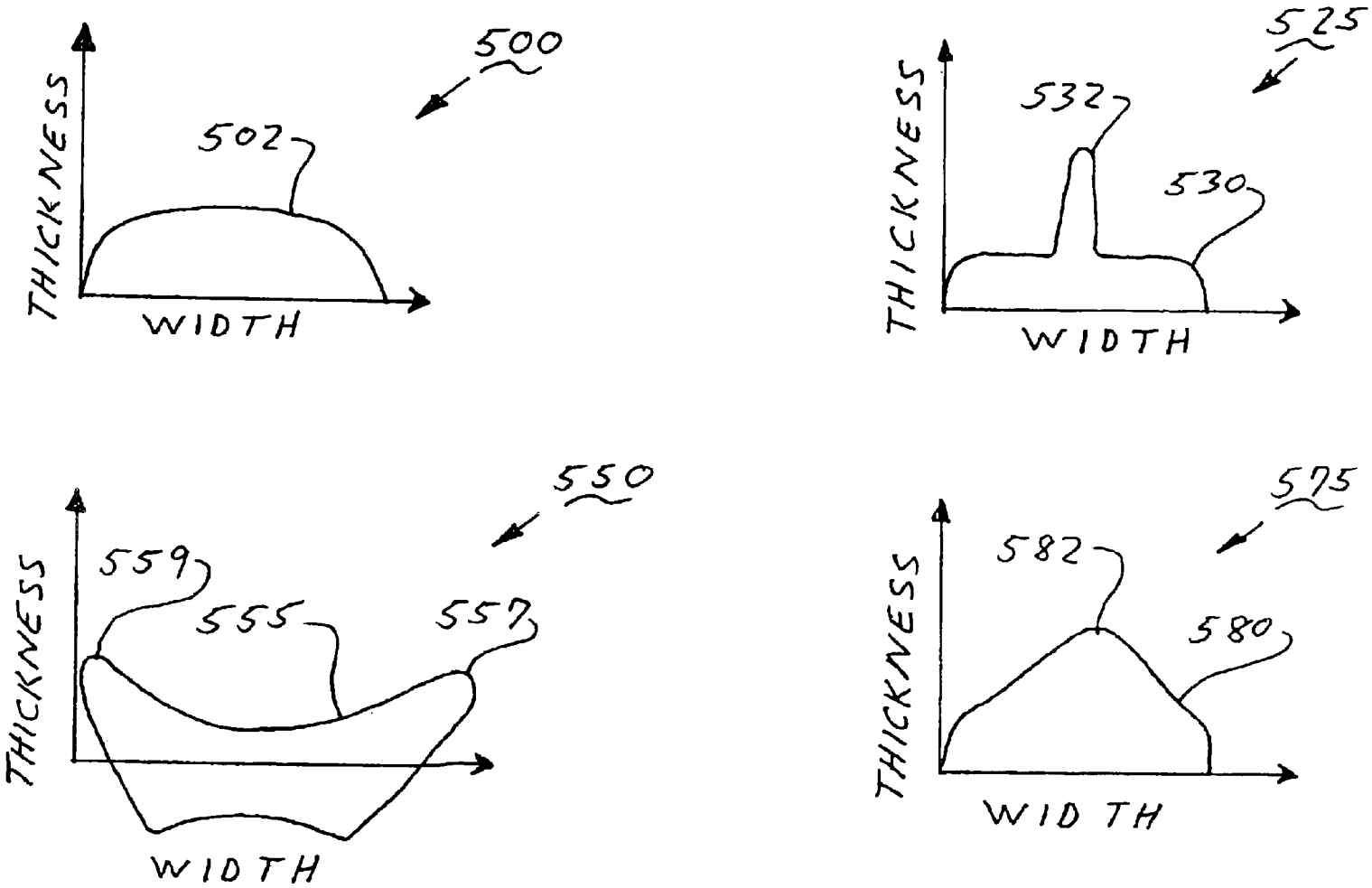
FIG. 5 illustrates several cross-sectional views of a stabilizer.

FIG. 5 illustrates several cross-sectional views of a stabilizer. With reference to FIG. 5, the cross section of the stabilizer can vary as a function of the width of the stabilizer according to different hydrodynamic shapes. For example, at 500, a rounded thickness is displayed as a function of stabilizer width. The cross-sectional variation of the portion of the stabilizer shown at 414 (FIG. 4) is displayed at 525 (FIG. 5). Thickness variation 530 has a peak thickness indicated at 532. Another thickness variation is shown at 550. Thickness variation 555 has symmetric peaks 557 and 559 which provide additional lateral stability to embodiments of the device while in submarine motion. An additional variation of stabilizer thickness as a function of stabilizer cross-sectional width is shown in 575 as variation 580. Variation 580 has one predominant peak at 582 and exhibits left/right symmetry about 582. Variations of stabilizer thickness as a function of cross-sectional width provide lateral stability to the device. Many variations of the stabilizer thickness as a function of the stabilizer width are possible and contemplated by one or more embodiments of the invention.

Figure 6:
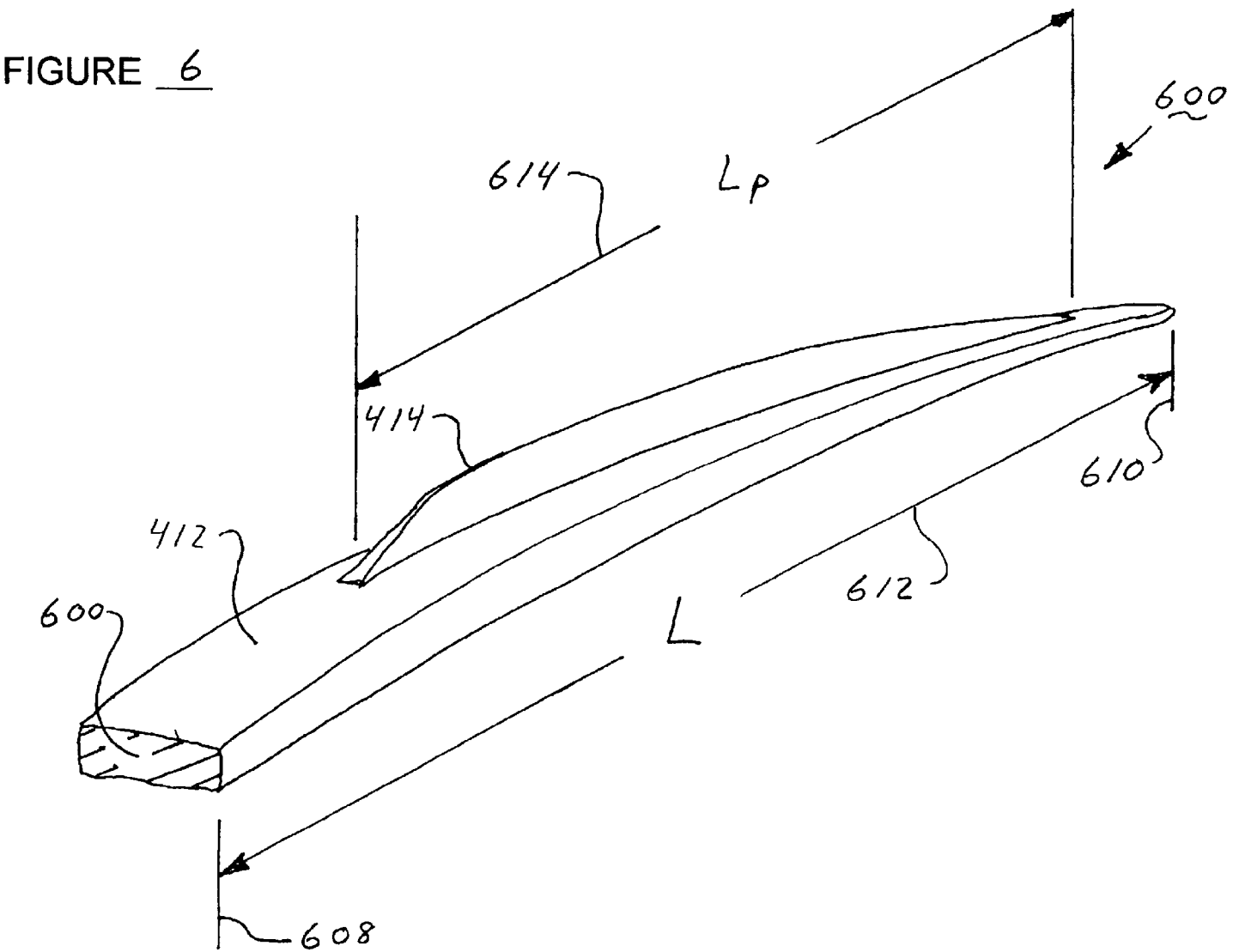
FIG. 6 contains an isometric view of a stabilizer according to one embodiment.

FIG. 6 contains an isometric view of a stabilizer according to one embodiment of the invention. With reference to FIG.

6, a portion L indicated by 612 of a stabilizer shown at 412 (FIG. 4) is displayed at 600. The stabilizer displays several thickness-to-width variations simultaneously. A cross section 600 taken at a length position 608 exhibits a substantially uniform variation of thickness with width. Across a portion of length L, indicated by $L_p$ at 614 the thickness of the stabilizer varies as a function of stabilizer thickness. Cross sections taken through the stabilizer along portion of length 614 would manifest the approximate shape shown in 525 (FIG. 5).

Figure 7:
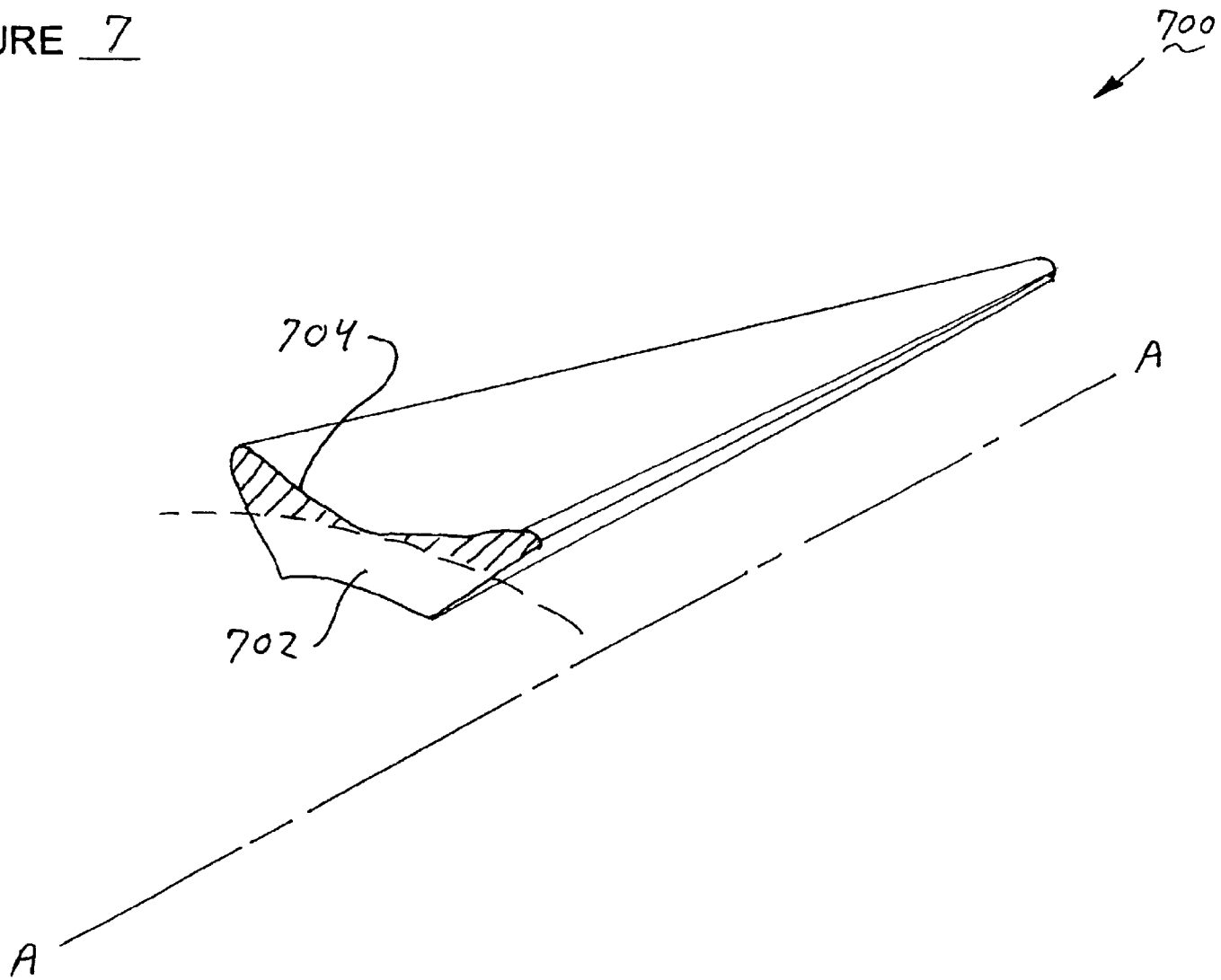
FIG. 7 illustrates another isometric view of a stabilizer according to one embodiment.

FIG. 7 illustrates another isometric view of a stabilizer at 700 according to one embodiment of the invention. With reference to FIG. 7, the cross-sectional view at 702 displays a variation of stabilizer thickness as a function of stabilizer width that is similar to that shown at 550 (FIG. 5). The stabilizer 700 also decreases in cross-sectional width as a function of stabilizer length.

Figure 8:
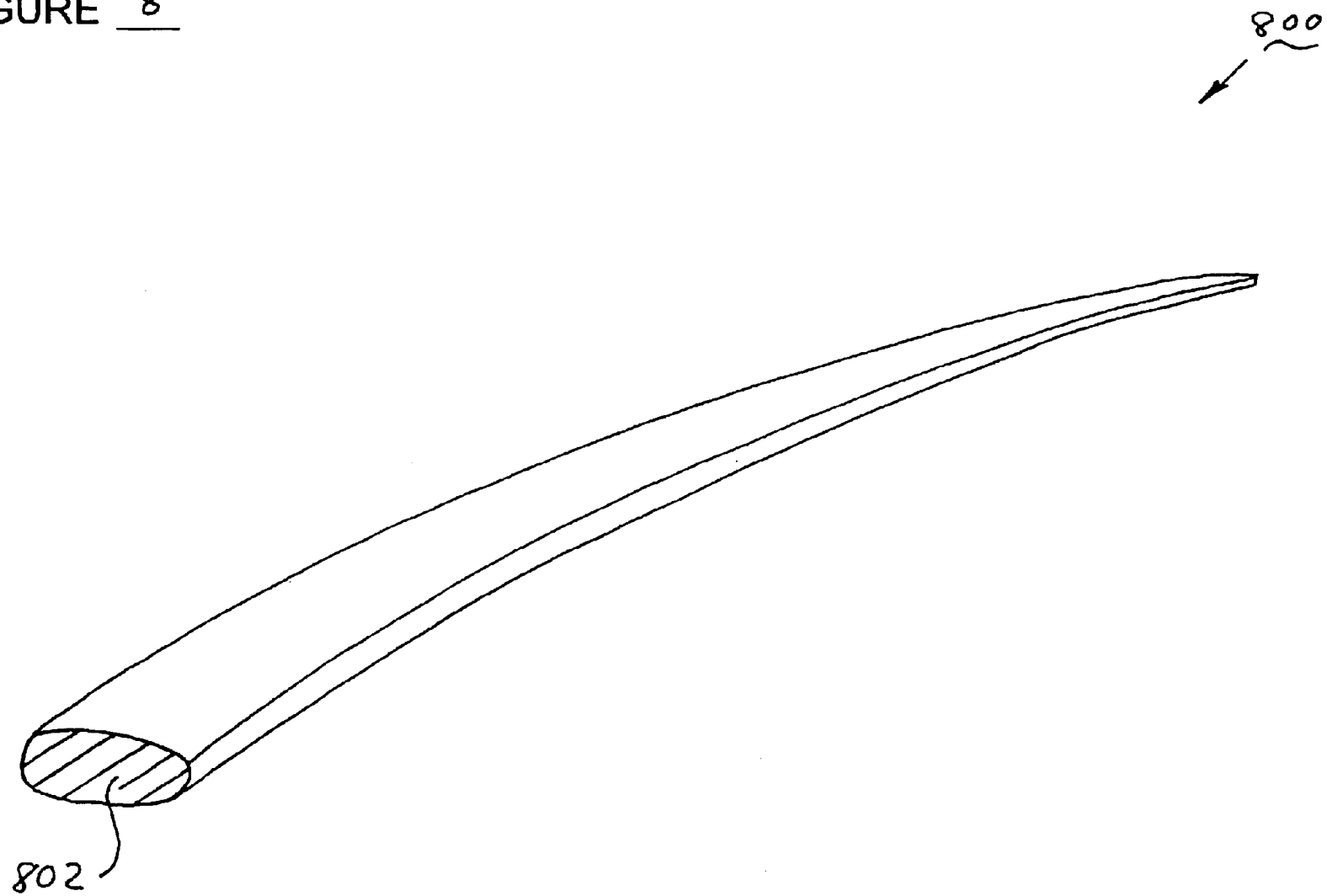
FIG. 8 displays another isometric view of a stabilizer according to one embodiment.

FIG. 8 displays another isometric view of a stabilizer at 800 according to one embodiment of the invention. The cross-sectional view shown at 802 is similar to the variation in stabilizer thickness as a function of stabilizer width shown at 500 in (FIG. 5). Stabilizer 800 provides a minimum amount of lateral stability relative to the three different designs shown in FIG. 6, FIG. 7, and FIG. 8.

In one or more embodiments, the invention is configured for mechanically assisted launch by employing energy storage and release during launch; thereby assisting the user. A user's arm is not optimally designed for a throwing motion through a body of water, for example, or any other dense fluid. Therefore, it is advantageous to employ other methods to impart energy to the device in order to propel the device into motion from a rest position.

Figure 9A:
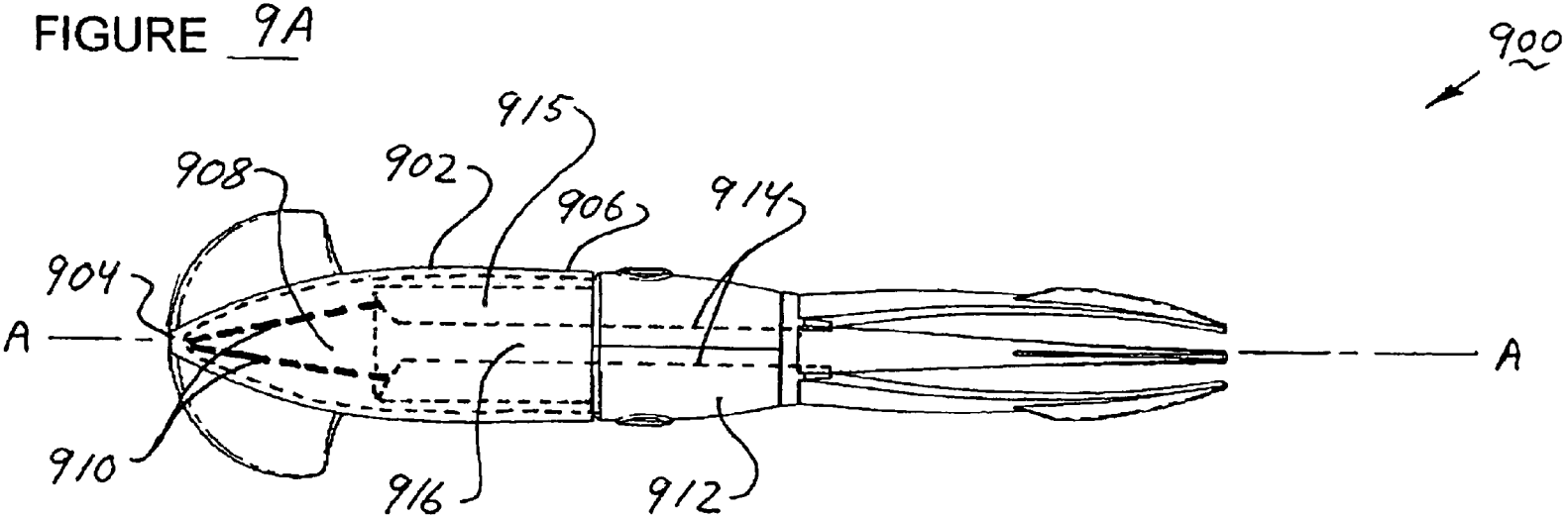
FIG. 9A illustrates one embodiment of a propulsion system utilizing elastic coupling.

FIG. 9A illustrates a propulsion system utilizing elastic coupling according to one embodiment of the invention. Referring to FIG. 9A, a substantially cylindrical section 902 has a first end 904 and a second end 906. The substantially cylindrical section 902 decreases in radius toward the first end 904 to provide a low drag hydrodynamic surface to the fluid into which the device 900 will be launched. Elastically coupled with the substantially cylindrical section 902 is a stabilizer 912. The stabilizer 912 has a longitudinal axis, indicated generally by AA and an internal void 916 continuously extending along its length, the void 916 permits fluid to enter the body of water and fill the cavity 908 in the substantially cylindrical section 902. The void 916 is defined by surfaces 914. The void 916 can be of arbitrary cross-sectional area; however, in one embodiment the cross section is circular. The stabilizer is elastically coupled to the first end 904 by an elastic member 910. The elastic member 910 can be made from any suitable elastic material capable of storing potential energy and then converting the stored potential energy to kinetic energy. Such a property anticipates a material that can undergo large deformation. Examples of such materials and parts are, but are not limited to urethane, thermoplastic rubber, surgical tubing, a rubber band, a bungee cord or a custom molded part. A forward end 915 of the stabilizer 912 is slidingly disposed within the substantially cylindrical section 902.

Figure 9B:
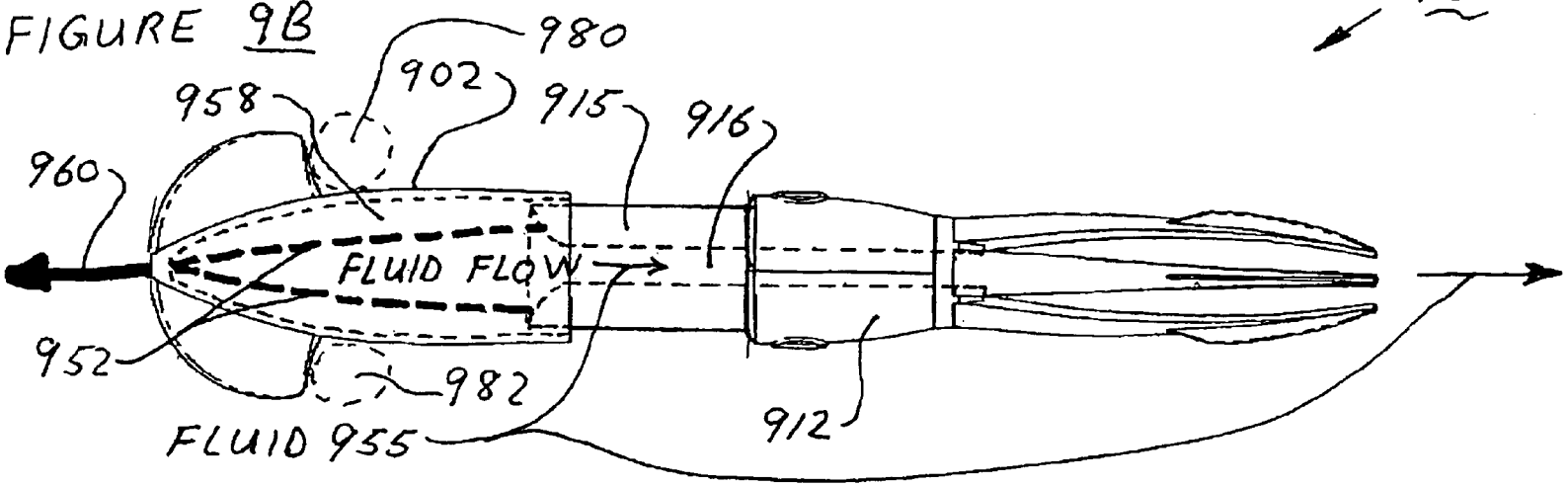
FIG. 9B illustrates one embodiment of a propulsion system utilizing elastic coupling.

In one embodiment, a launch sequence commences by a user gripping the substantially cylindrical section 902 with one hand and pulling the stabilizer 912 with the other hand. The device will elongate to the position substantially shown in FIG. 9B. As the device elongates, fluid from the body of fluid that the device is immersed into fills the cavity 908 (FIG. 9A) as the volume of the cavity 908 expands to the volume shown at 958 (FIG. 9B). According to this embodiment, the volume of the cavity is variable.

With reference to FIG. 9B, the elastic member 910 (FIG. 9A) is stretched to elongated position 952 storing potential energy thereby. The launch sequence proceeds by the user releasing the stabilizer 912. The user's remaining hand holds the substantially cylindrical section 902 just behind the control surfaces; two fingers from the user's hand are indicated by 980 and 982. Upon release of the stabilizer 912, potential energy is converted to kinetic energy whereby stabilizer 912 moves in the direction shown by an arrow 960. The cavity 958 decrease in volume as fluid flow 955 proceeds out of the cavity, thereby propelling the device 950 in the direction of motion indicted by the arrow 960. Other propulsion systems are contemplated and illustrated in the following figures.

Figure 10A:
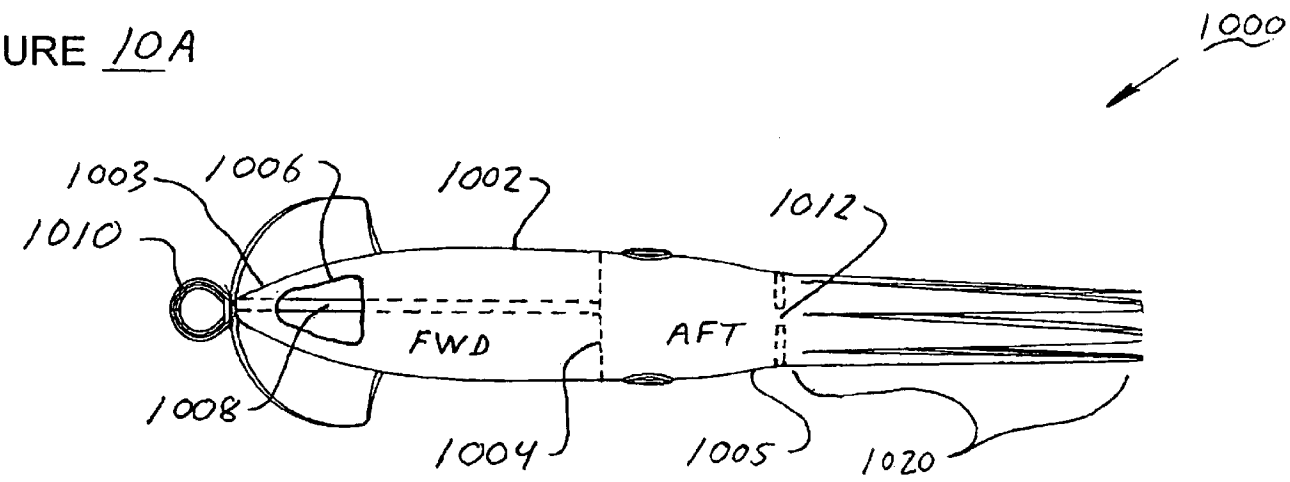
FIG. 10A illustrates one embodiment of a propulsion system utilizing an elastic membrane.
Figure 10B:
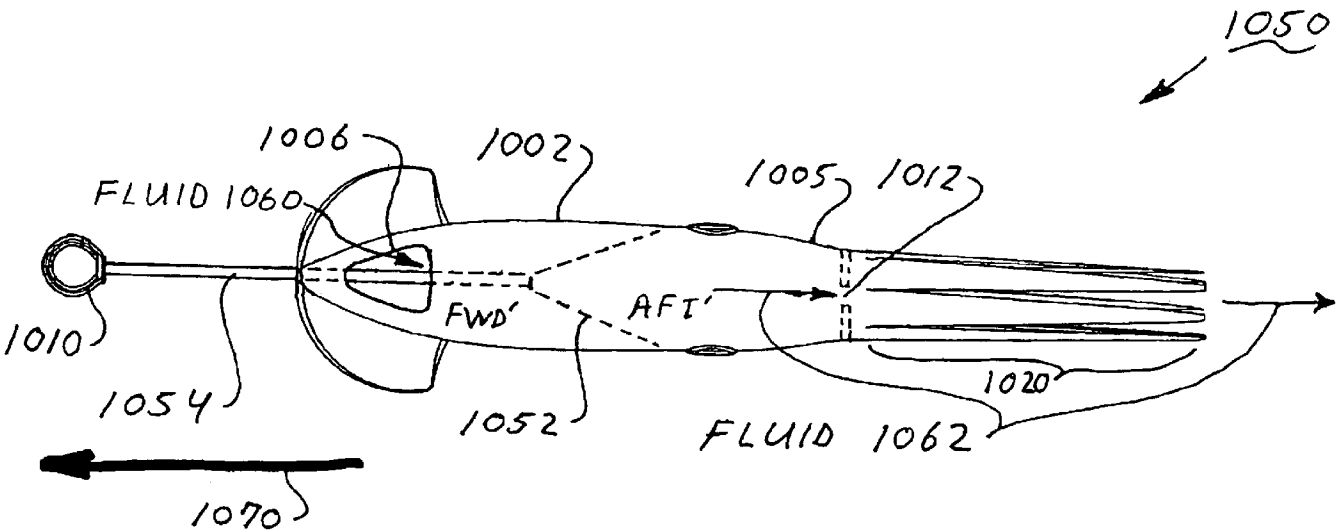
FIG. 10B illustrates one embodiment of a propulsion system utilizing an elastic membrane.

FIG. 10A illustrates a propulsion system incorporated into device 1000 utilizing an elastic membrane according to one embodiment of the invention. With reference to FIG. 10A, a substantially cylindrical section 1002 has a first end indicated at 1003 and a second end indicated at 1005. In FIG. 10A, the thickness of the substantially cylindrical section is not indicated by dashed lines as it was previously in FIG. 9A and FIG. 9B; however, those of ordinary skill in the art will recognize that the substantially cylindrical section 1002 has a cavity therein divided into two portions; a forward portion and an aft portion, so indicated on FIG. 10A by the symbol FWD and AFT, respectively. A membrane 1004 divides the cavity into the forward and aft portions. The membrane is flexible and is coupled to a launch member 1008. The launch member 1008 emerges from the first end 1003 through a hole disposed therein. A grip device 1010 (a loop in this embodiment) is provided at the end of the launch member so that the user can extend the launch member from the substantially cylindrical section 1002, thereby stretching the membrane 1004 (FIG. 10A) from the unstretched to the stretched position as indicated in FIG. 10B at 1052.

In one embodiment, a launch sequence commences when the user pulls the second end 1005 with one hand while pulling the grip device 1010 with the other hand, thereby stretching the membrane 1052 and storing potential energy therein. The forward portion of the cavity FWD (FIG. 10A) decreases in size to FWD' (FIG. 10B) and the aft portion of the cavity AFT (FIG. 10A) increases in size to AFT' (FIG. 10B). Fluid from the body of fluid that the device 1050 is immersed in, both fills the AFT' portion and is expelled from the FWD' portion as the membrane 1052 is enlarged to the stretched state.

The user releases the second end 1005 thereby allowing the membrane 1052 to return to the unstressed state: during this phase of launch fluid 1062 is expelled from the AFT' portion of the cavity and fluid 1060 from the body of fluid that the device is immersed into refills the FWD' portion of the cavity through a fluid intake port 1006. The fluid 1062 is expelled through an opening 1012 as shown in the second end 1005 of the substantially cylindrical section 1002. Upon release by the user, the device 1050 is propelled in the direction indicated by arrow 1070 and the extended launch member 1054 returns to the retracted position indicated at 1008 in FIG. 10A.

In one or more embodiments, the grip device 1010 can be configured to be housed within the hydrodynamic shape of the device 1000 when retracted to minimize drag. A variety of grip devices are possible within the teachings herein and the corresponding housing is adapted to either partially or fully receive the grip device within its outer envelope.

In one or more embodiments, the launch member can also store potential energy through elastic deformation which is converted to kinetic energy upon release by the user, thereby increasing the amount of energy transferred to the device 1050 during the launch sequence. Additional conversion of potential to kinetic energy translates into a higher launch velocity, thus propelling the device 1050 greater distances in the submarine environment.

In one or more embodiments, the substantially cylindrical section 1002 can be configured to function as the elastic membrane of FIG. 10B; thereby combining the two cavities into one cavity and eliminating the intake port shown in FIG. 10B. Such an arrangement utilizes the substantially cylindrical section 1002 for energy storage during the launch sequence. In this embodiment, fluid need not be expelled from the device during launch; however, no limitation is imposed by this embodiment on the use of expelled fluid for propulsion. Alternative methods of launching the device include gripping the device by stabilizer 1020. In this scenario, the user can grip the device by the stabilizer 1020 during the retraction phase and then release the device by releasing the stabilizer 1020. Energy storage within the stabilizer 1020 can aid launch velocity by selecting suitable materials for the stabilizer that undergo elastic deformation, such as urethane, thermoplastic rubber, and other suitable materials that are well known by those of ordinary skill in the art.

Figure 11:
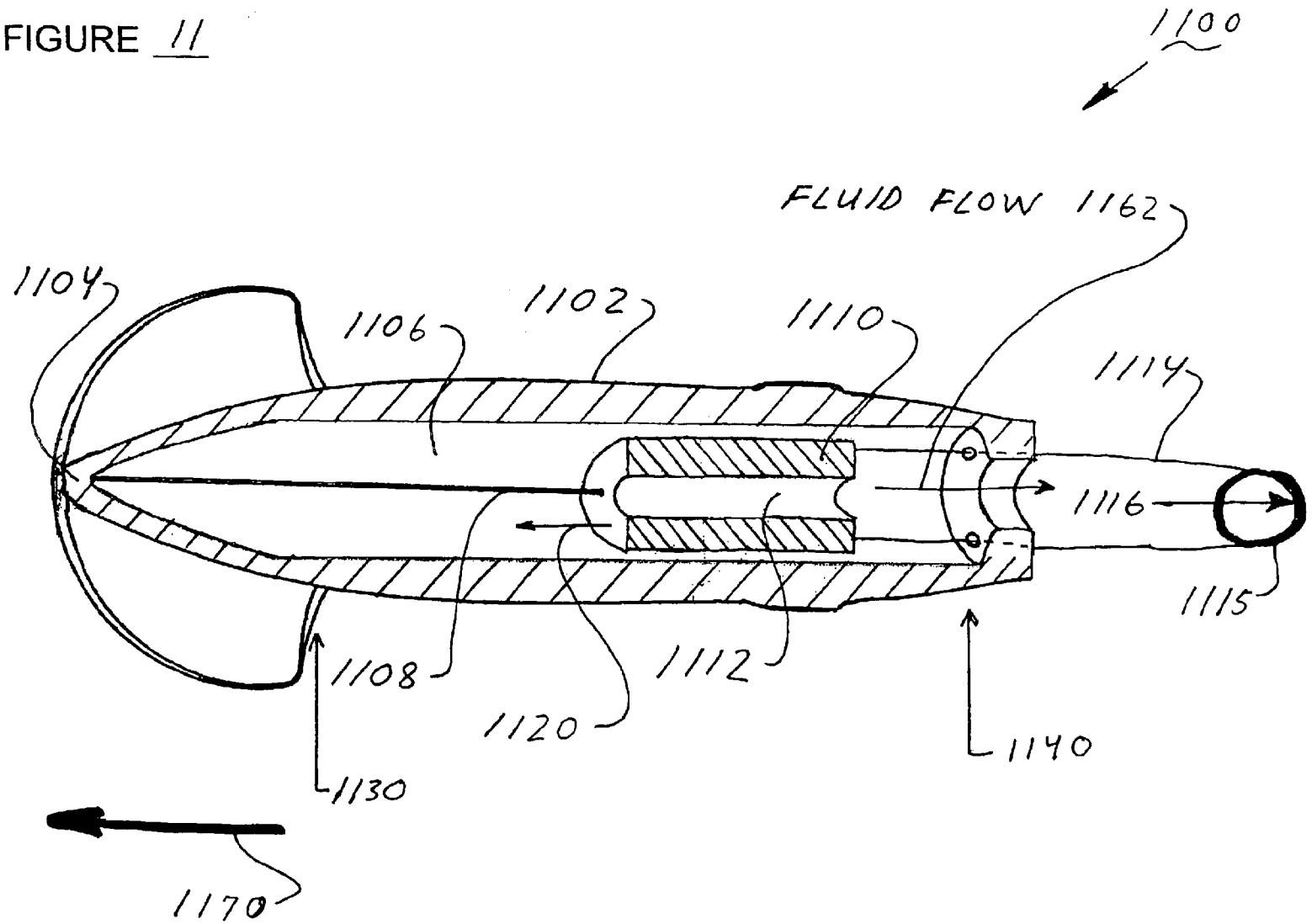
FIG. 11 illustrates an embodiment of a propulsion system utilizing a piston.

FIG. 11 illustrates a propulsion system for a device 1100 utilizing a piston according to one embodiment of the invention. With respect to FIG. 11, a piston slidingly disposed within the substantially cylindrical section 1102. The device 1100 is immersed in a body of fluid and includes a substantially cylindrical section 1102 decreasing in radius toward a first end 1104, thereby providing a low drag hydrodynamic profile to flow when the device 1100 is in motion. A cavity 1106 is disposed within the substantially cylindrical section 1102 and a piston 1110 is slidingly disposed in the cavity 1106. The piston 1110 has a void 1112 extending through the piston 1110 so that fluid can pass through the void during the launch phase. The first end 1104 and the forward end of the piston are elastically coupled with an elastic member 1108. The elastic member 1108 can be made from any suitable elastic material capable of storing potential energy and then converting the stored potential energy to kinetic energy. Such a property anticipates a material that can undergo large deformation. Examples of such materials and parts are, but are not limited to urethane, thermoplastic rubber, surgical tubing, a rubber band, a bungee cord or a custom molded part.

A grip device 1114 is attached to the piston 1110. The grip device is used to retract the piston 1110 from a first position to a second position within the cavity 1106. An example of a first position is indicated by an arrow at 1130, such a position is established by an unloaded length of the elastic member 1108. The piston 1110 can be retracted to any arbitrary second position along the void 1106 within which the piston is slidingly disposed. An example of such a second position is indicated by an arrow 1140.

The launch sequence proceeds when a user grips the substantially cylindrical section 1102 with one hand; to do this, the user's fingers can be placed as shown at 980 and 982 (FIG. 9B). With the other hand, the user grips the grip device 1114 and retracts the piston 1110, thereby allowing fluid from the body of fluid in which the device 1100 is immersed, to fill the cavity 1106. The user completes the launch sequence by releasing the grip device 1114. Upon releasing the grip device, the piston moves in the direction indicated by arrow 1120, fluid is expelled from cavity 1106 as shown by fluid flow 1162 propelling the device 1100 in the direction of travel indicated by arrow 1170.

The grip device 1114 can be provided with various structures such as flexible cord, chain or a rod. Additionally, in one embodiment, a ring 1115 can be built into the grip device 1114, as shown, to aid in distributing the load incident upon the user's finger. One or more elastic members can be used to elastically couple the piston 1110 to the first end 1104; only one elastic member 1108 is shown in FIG. 11 to preserve clarity in the illustration.

As used in this description, "one embodiment," "one or more embodiments," "an embodiment" or similar phrases means that feature(s) being described are included in at least one embodiment of the invention. References to "one embodiment" or any reference to an embodiment in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting.

What is claimed is:

1. An apparatus comprising:

a substantially cylindrical section having a first end, a second end, and a cavity disposed therein to receive fluid, wherein the substantially cylindrical section decreases in radius toward the first end, the substantially cylindrical section further including control surfaces disposed thereon;

a stabilizer coupled with the substantially cylindrical section, to stabilize motion of the apparatus in a body of fluid when the apparatus is to be launched by a user;

an elastic membrane attached to the substantially cylindrical section dividing the cavity into a forward portion and an aft portion;

a fluid intake port to allow fluid to enter the forward portion; and a launch member coupled with the elastic membrane, the launch member extending through a hole in the first end wherein the launch member terminates into a means for gripping, such that when the user is to pull the means for gripping to elongate the elastic membrane, the forward portion of the cavity is to shrink and the aft portion of the cavity is to expand and fluid is to be expelled from the second end while more fluid is to fill the forward portion through the fluid intake port, and the apparatus is to be propelled through the body of fluid.

2. The apparatus of claim 1, wherein the hole is the fluid intake port.

3. The apparatus of claim 3, wherein the launch member is to elongate under load to store energy.

4. An apparatus comprising:

a substantially cylindrical section having a first end, a second end, and a cavity disposed therein to receive fluid, wherein the substantially cylindrical section decreases in radius toward the first end, the substantially cylindrical section further including control surfaces disposed thereon; and a stabilizer coupled with the substantially cylindrical section, to stabilize motion of the apparatus in a body of fluid when the apparatus is to be launched by a user, wherein the stabilizer is in the shape of a tentacle.

5. The apparatus of claim 4, wherein the internal void passes through the stabilizer.

6. The apparatus of claim 4, wherein at least a part of the apparatus glows in the dark.

7. The apparatus of claim 4, further comprising:

a volume of material located proximate to the control surfaces having a density greater than a density of the body of fluid.

8. An apparatus comprising:

a substantially cylindrical section having a first end, a second end, and a cavity disposed therein to receive fluid, wherein the substantially cylindrical section decreases in radius toward the first end, the substantially cylindrical section further including control surfaces disposed thereon;

a stabilizer coupled with the substantially cylindrical section, to stabilize motion of the apparatus in a body of fluid when the apparatus is to be launched by a user; and an aft member having a forward end and a rear end wherein the forward end is coupled with the second end and the rear end is coupled with an aft body.

9. An apparatus comprising:

a substantially cylindrical section having a first end, a second end, and a cavity disposed therein to receive fluid, wherein the substantially cylindrical section decreases in radius toward the first end, the substantially cylindrical section further including control surfaces disposed thereon; and a stabilizer coupled with the substantially cylindrical section, to stabilize motion of the apparatus in a body of fluid when the apparatus is to be launched by a user, wherein the stabilizer has a length and a cross sectional area, wherein the cross sectional area decreases as a function of the length.

10. The apparatus of claim 9, wherein at least along a part of the length of the stabilizer, a thickness of the stabilizer varies as a function of a width of the stabilizer.

11. An apparatus comprising:

a substantially cylindrical section having a first end, a second end, and a cavity disposed therein to receive fluid, wherein the substantially cylindrical section decreases in radius toward the first end, the substantially cylindrical section further including control surfaces disposed thereon; and a stabilizer coupled with the substantially cylindrical section, to stabilize motion of the apparatus in a body of fluid when the apparatus is to be launched by a user, wherein the stabilizer is releasably coupled with the substantially cylindrical section and the cavity is sealed by the stabilizer.

12. An apparatus comprising:

a substantially cylindrical head having a first end, a second end, and a wall thickness defining a cavity therein to receive a fluid, wherein the substantially cylindrical head decreases in radius toward the first end, the substantially cylindrical head further including control surfaces disposed thereon;

a substantially cylindrical body having a longitudinal axis and an internal void continuously extending along the longitudinal axis, the substantially cylindrical body coupled with the second end of the substantially cylindrical head; and a stabilizer coupled with the substantially cylindrical body to stabilize motion of the apparatus in a body of fluid when the apparatus is to be launched by a user.

13. The apparatus of claim 12, further comprising:

a means for launching the apparatus by the user.

14. The apparatus of claim 12, wherein the stabilizer is releasably coupled with the substantially cylindrical body and the internal void is sealed by the stabilizer.

15. The apparatus of claim 12, further comprising;

means for sealing the internal void.

16. The apparatus of claim 12, further comprising:

an internal void plug to seal the internal void from the body of fluid.

17. The apparatus of claim 16, wherein the internal void plug is selected from the group consisting of a stopper, a stabilizer, and a valve.

18. The apparatus of claim 12, wherein the stabilizer is releasably coupled with the substantially cylindrical body and the internal void passes through the stabilizer.

19. The apparatus of claim 18, wherein at least a part of the apparatus glows in the dark.

20. The apparatus of claim 18, wherein the stabilizer is in the shape of a tentacle.

21. The apparatus of claim 18, wherein the stabilizer has a length and a cross sectional area, wherein the cross sectional area decreases as a function of the length.

22. The apparatus of claim 12, wherein at least a part of the apparatus glows in the dark.

23. The apparatus of claim 12, further comprising:

a volume of material located proximate to the control surfaces having a density greater than a density of the body of fluid.

24. An apparatus comprising:

a substantially cylindrical head having a first end and a second end, wherein the substantially cylindrical head decreases in outer radius toward the first end, and the substantially cylindrical head having a cavity disposed therein to receive a fluid, the cavity opening at the second end;

a substantially cylindrical body having a longitudinal axis and an internal void continuously extending along the longitudinal axis, the substantially cylindrical body coupled with the second end; and a stabilizer coupled with the substantially cylindrical body to stabilize motion of the apparatus in a body of fluid when the apparatus is to be launched by a user, wherein the stabilizer is in the shape of a tentacle.

25. The apparatus of claim 24, further comprising:

control surfaces disposed on the substantially cylindrical head.

26. The apparatus of claim 25, further comprising:

a volume of material located proximate to the control surfaces having a density greater than a density of the body of fluid.

27. The apparatus of claim 24, wherein at least a part of the apparatus glows in the dark.

28. An apparatus comprising:

a substantially cylindrical head having a first end and a second end, wherein the substantially cylindrical head decreases in outer radius toward the first end, and the substantially cylindrical head having a cavity disposed therein to receive a fluid, the cavity opening at the second end;

a substantially cylindrical body having a longitudinal axis and an internal void continuously extending along the longitudinal axis, the substantially cylindrical body coupled with the second end;

a stabilizer coupled with the substantially cylindrical body to stabilize motion of the apparatus in a body of fluid when the apparatus is to be launched by a user; and an aft member having a forward end and a rear end wherein the forward end is coupled with the second end and the rear end is coupled with an aft body.

29. The apparatus of claim 28, wherein the aft body is selected from the group consisting of a plane, a solid of revolution, a fin, and a control surface.

30. An apparatus comprising:

a substantially cylindrical head having a first end and a second end, wherein the substantially cylindrical head decreases in outer radius toward the first end, and the substantially cylindrical head having a cavity disposed therein to receive a fluid, the cavity opening at the second end;

a substantially cylindrical body having a longitudinal axis and an internal void continuously extending along the longitudinal axis, the substantially cylindrical body coupled with the second end; and a stabilizer coupled with the substantially cylindrical body to stabilize motion of the apparatus in a body of fluid when the apparatus is to be launched by a user; wherein the stabilizer has a length and a cross sectional area, wherein the cross sectional area decreases as a function of the length.

31. The apparatus of claim 30, wherein at least along a part of the length of the stabilizer, a thickness of the stabilizer varies as a function of a width of the stabilizer.

32. An apparatus comprising:

a substantially cylindrical head having a first end and a second end, wherein the substantially cylindrical head decreases in outer radius toward the first end, and the substantially cylindrical head having a cavity disposed therein to receive a fluid, the cavity opening at the second end;

a substantially cylindrical body having a longitudinal axis and an internal void continuously extending along the longitudinal axis, the substantially cylindrical body coupled with the second end; and a stabilizer coupled with the substantially cylindrical body to stabilize motion of the apparatus in a body of fluid when the apparatus is to be launched by a user, wherein the stabilizer is releasably coupled with the substantially cylindrical body and the internal void is sealed by the stabilizer.

33. An apparatus comprising:

a substantially cylindrical head having a first end and a second end, wherein the substantially cylindrical head decreases in outer radius toward the first end, and the substantially cylindrical head having a cavity disposed therein to receive a fluid, the cavity opening at the second end;

a substantially cylindrical body having a longitudinal axis and an internal void continuously extending along the longitudinal axis, the substantially cylindrical body coupled with the second end;

a stabilizer coupled with the substantially cylindrical body to stabilize motion of the apparatus in a body of fluid when the apparatus is to be launched by a user; and means for sealing the internal void.

34. An apparatus comprising:

a substantially cylindrical head having a first end and a second end, wherein the substantially cylindrical head decreases in outer radius toward the first end, and the substantially cylindrical head having a cavity disposed therein to receive a fluid, the cavity opening at the second end;

a substantially cylindrical body having a longitudinal axis and an internal void continuously extending along the longitudinal axis, the substantially cylindrical body coupled with the second end;

a stabilizer coupled with the substantially cylindrical body to stabilize motion of the apparatus in a body of fluid when the apparatus is to be launched by a user; and an internal void plug to seal the internal void from the body of fluid.

35. The apparatus of claim 34, wherein the internal void plug is selected from the group consisting of a stopper, a stabilizer, and a valve.

* * * * *